US009442446B2

(12) United States Patent
Kawakami et al.

(10) Patent No.: US 9,442,446 B2
(45) Date of Patent: Sep. 13, 2016

(54) IMAGE FORMING APPARATUS HAVING A USER AUTHENTICATION OPERATION AND POWER STATE THAT ARE CONTROLLED DEPENDING ON ALARM LEVEL OF DISASTER INFORMATION

(71) Applicant: KYOCERA Document Solutions Inc., Osaka (JP)

(72) Inventors: Satoshi Kawakami, Osaka (JP); Masaya Okuda, Osaka (JP); Yoshitaka Matsuki, Osaka (JP); Yuri Moritani, Osaka (JP); Tsuyoshi Nitta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/839,968

(22) Filed: Aug. 29, 2015

(65) Prior Publication Data

US 2016/0062289 A1 Mar. 3, 2016

(30) Foreign Application Priority Data

Aug. 29, 2014 (JP) ..... 2014-175561

(51) Int. Cl.
*G03G 15/00* (2006.01)

(52) U.S. Cl.
CPC ..... *G03G 15/5016* (2013.01); *G03G 15/5004* (2013.01); *G03G 2215/00109* (2013.01)

(58) Field of Classification Search
CPC ..... G03G 15/5016
USPC ..... 399/80, 9
See application file for complete search history.

(56) References Cited

U.S. PATENT DOCUMENTS

2008/0205909 A1* 8/2008 Koakutsu ..... G03G 15/5079 399/9

FOREIGN PATENT DOCUMENTS

JP 2001-014051 A 1/2001

* cited by examiner

*Primary Examiner* — Quana M Grainger
(74) *Attorney, Agent, or Firm* — Hawaii Patent Services; Nathaniel K. Fedde; Kenton N. Fedde

(57) ABSTRACT

Provided is an image forming apparatus that controls a user authentication and a switching action for switching into a specific operation mode (either one of first and second power saving modes, and emergency stop), depending an alarm level of disaster information. A user authentication function circuit is for performing the user authentication. An operation mode switching circuit is for switching a current operation mode into the specific operation mode. A disaster information acquire circuit is for receiving disaster information representing the alarm level. A system control circuit controls, depending on the alarm level, the user authentication operation by the user authentication function circuit and a switching of one of the operation modes by the operation mode switching circuit. The aforementioned specified operation mode is either one of the user authentication mode, the first power saving mode, the second power saving mode, and the emergency stop.

2 Claims, 4 Drawing Sheets

(CONTROL LIST BASED ON ALARM LEVEL OF DISASTER INFORMATION)

400

| ALARM LEVEL | SEISMIC INTENSITY | CONTROL MODE |
|---|---|---|
| ALARM LEVEL 1 | SEISMIC INTENSITY OF 1 TO ABOUT 2 | REMAIN USER AUTHENTICATION FUNCTION<br>FIRST POWER SAVING MODE (LOW POWER MODE) |
| ALARM LEVEL 2 | SEISMIC INTENSITY OF 3 | REMAIN USER AUTHENTICATION FUNCTION<br>FIRST POWER SAVING MODE (LOW POWER MODE) |
| ALARM LEVEL 3 | SEISMIC INTENSITY OF 4 | DEACTIVATE USER AUTHENTICATION FUNCTION<br>SECOND POWER SAVING MODE (SLEEP MODE) |
| ALARM LEVEL 4 | SEISMIC INTENSITY OF 5-LOWER | DEACTIVATE USER AUTHENTICATION FUNCTION<br>SECOND POWER SAVING MODE (SLEEP MODE) |
| ALARM LEVEL 5 | SEISMIC INTENSITY OF 5-UPPER TO 6-LOWER | DEACTIVATE USER AUTHENTICATION FUNCTION<br>SECOND POWER SAVING MODE (SLEEP MODE) |
| ALARM LEVEL 6 | SEISMIC INTENSITY OF 6-UPPER OR ABOVE | EMERGENCY STOP |

FIG.3

IMAGE FORMING APPARATUS HAVING A USER AUTHENTICATION OPERATION AND POWER STATE THAT ARE CONTROLLED DEPENDING ON ALARM LEVEL OF DISASTER INFORMATION

INCORPORATION BY REFERENCE

This application is based on and claims the benefit of priority from Japanese Patent Application No. 2014-175561 filed on Aug. 29, 2014, the contents of which are hereby incorporated by reference.

BACKGROUND

The present disclosure relates to an image forming apparatus that has a user authentication function.

For example, image forming apparatuses include a printer, a multi-function printer and a combined-machine such as an MFP (Multifunction Peripheral). In some image forming apparatuses, there are stored personal information and in-house confidential information. From view point of security and the like, measures are taken for the prevention of leakage of these information pieces to the outside. One of the measures is a user authentication function provided to the image forming apparatus. This allows a user to receive an authentication only when password and/or ID that the user inputs are in coincidence with previously registered password and/or ID. Only the user who has received the authentication can access and retrieve specific information.

Incidentally, some image forming apparatuses of such a type allow for printing, say, a preregistered emergency support information piece or the like. However, sometimes the image forming apparatus that is provided with the user authentication function may fail to achieve the user authentication function piece. Thus, it is predicted that printing the emergency support information piece or the like may be made unsuccessfully.

In addition, in a case of an emergency disaster, a large scale disaster (such as a large scale earthquake) may be predicted by which the image forming apparatus may be overturned or out of order. Under such an emergency environment, it is essential to prevent an outbreak of fire due to a heat source such as a heater of a fixing part, electric shock by a high voltage power source part, and splashing of toner or the like. For this reason, an action is requested such as causing the image forming apparatus to stop in an emergency.

Under such environments, as a typical case, it is possible to think of an application of a user authentication method of a user authentication device. In such a case, when a signal that is indicative of an emergency, the user authentication is deactivated. Thus, it is possible to manipulate a monitoring system without performing the user authentication.

SUMMARY

An image forming apparatus according to an embodiment of the present disclosure is featured to include a user authentication function circuit that performs a user authentication, an operation mode switching circuit that perform a switching action for switching a current operation mode into a specific operation mode, a disaster information acquiring circuit that acquires disaster information that is indicative of an alarm level, and a system control circuit that controls, depending on the alarm level, to perform the user authentication operation by the user authentication function circuit and to perform the switching action by the operation mode switching circuit, the specified operation mode is either one of the first power saving mode, the second power saving mode, and the emergency stop.

BRIEF DESCRIPTION OF THE DRAWINGS

FIG. 3 illustrates a control list based on disaster information that is acquired from an information distributing server.

DETAILED DESCRIPTION

Hereinbelow, an exemplary embodiment of an image forming apparatus according to the present disclosure will be described with reference to FIG. 1 to FIG. 4. It is to be noted that the image forming apparatus that will be described below is in the form of, for example, a printer, a multi-function printer, and an MFP (Multifunction Peripheral).

Figure 1:
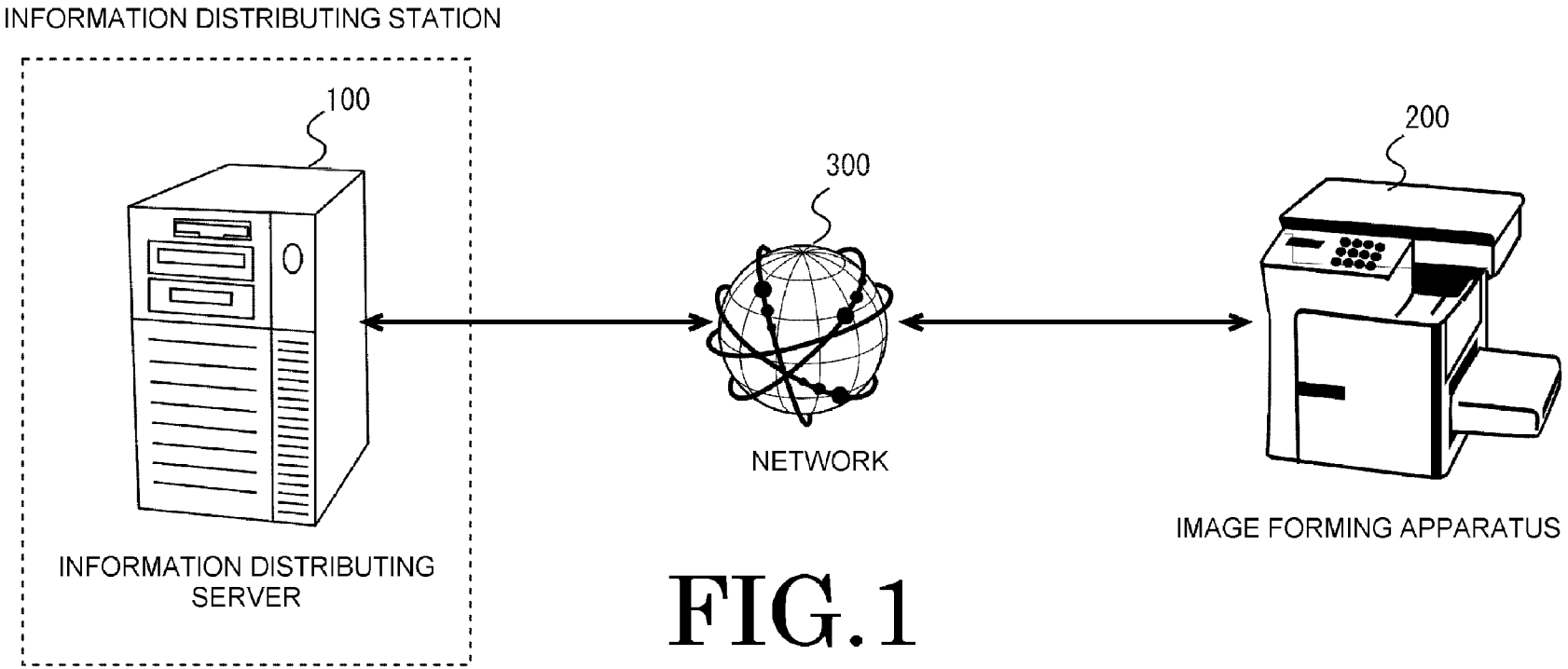
FIG. 1 illustrates a system configuration that is for explaining an exemplary embodiment of an image forming apparatus according to the present disclosure.

First of all, as illustrated in FIG. 1, an image forming apparatus 200 is connected to an information distributing server 100 via a network 300 such as Internet.

The information distributing server 100 distributes, when various disasters, such as earthquake, tidal waves, and abnormal weather, occur, disaster information via the network, which is related to the resultant disaster(s).

Figure 2:
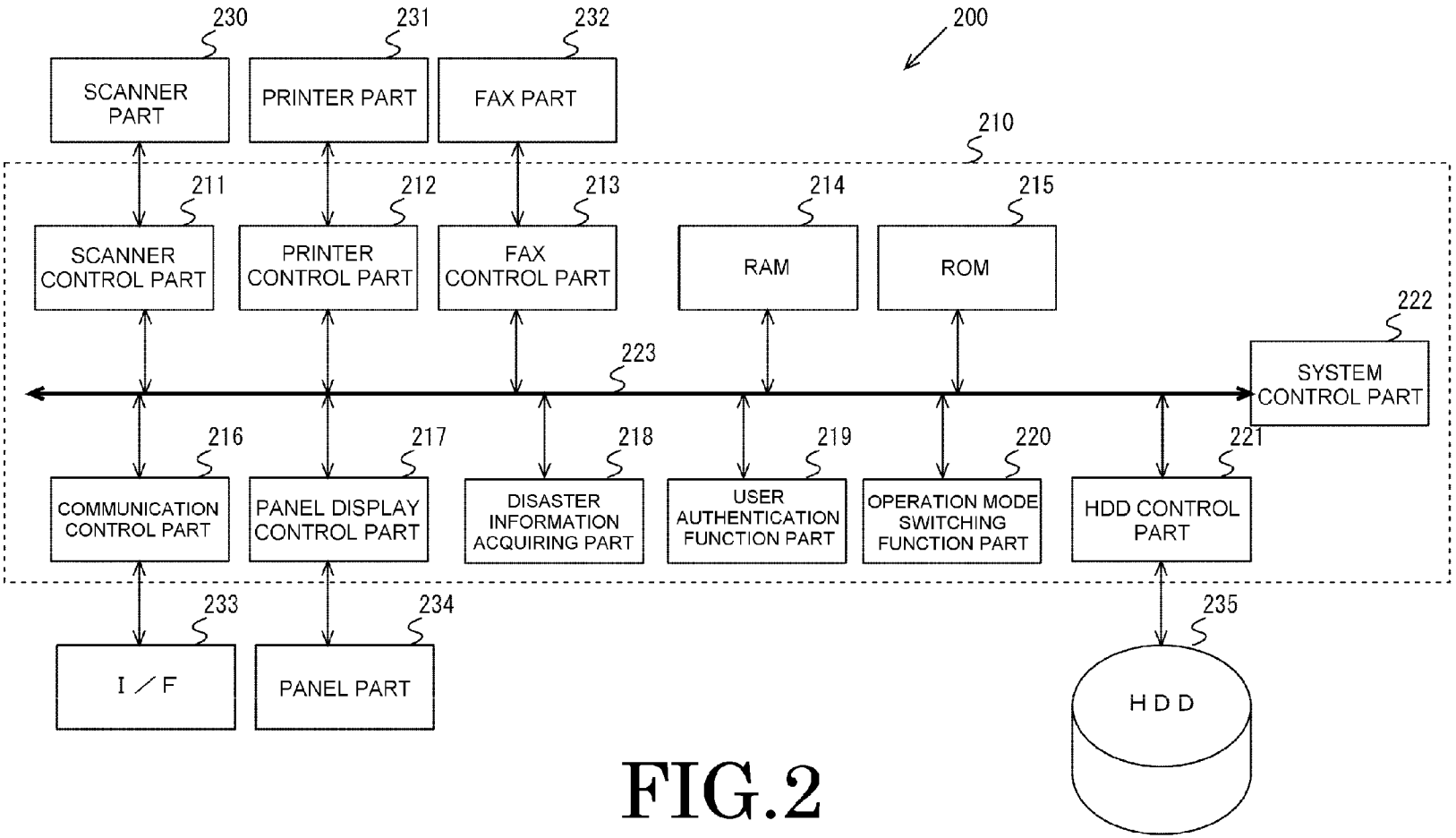
FIG. 2 illustrates a configuration of the image forming apparatus that is illustrated in FIG. 1.

Next, with reference to FIG. 2, a configuration of the image forming apparatus 200 will be described. The image forming apparatus 200 includes a control part 210, a scanner part 230, a printer part 231, a FAX part 232, an I/F (interface) 233, a panel part 234, and an HDD (Hard Disc Drive) 235.

The scanner part 230 is a circuit that has a scanner for inputting an image signal of a manuscript that is read by an image sensor to the control part 210. In detail, the scanner part 20 converts the image signal of the manuscript from the image sensor into a digitalized image data. The scanner part 230 inputs plural sets of the digitalized image data, one by one, to the control part 210.

The printer part 231 is a circuit that has a printer for printing, based on an image data that is outputted from the control part 231, an image on a sheet. The FAX part 232 is for transmitting the image data outputted from the control part 210, via a telephone line, to an opposite facsimile device. In addition, the FAX part 23 is also a circuit such as facsimile board that receives an image data from the opposite facsimile device and inputs the resulting image data to the control part 210. In other words, the FAX part 232 controls a connection to the telephone line using a NCU (Network Control Unit). Also, the FAX part 232 compresses the image data outputted from the control part 210 and modulates the resulting image data for a transmission thereof to the opposite facsimile device. In addition, the FAX part 232 connects to the telephone line via the NCU. Then, the FAX part 232 demodulates the image data from the opposite facsimile device and expands the resulting image data for an input to the control part 210.

The I/F 233 is a circuit such as network interface card for establishing a data communication, via the network 300, to, for example, the information distributing server 100. It is to be noted, the I/F 232 is also capable of establishing a data transmission/reception with a client terminal, or the like.

The panel part 234 is a circuit for accepting a selection of either one of a printer function, a FAX function, and a scanner function of the image forming apparatus 200.

The HDD 235 stores programs or the like that provide various functions to the image forming apparatus 200. Examples of the programs include a copy function providing program that provides a copy function, a print function providing program that provides a print function, a scanner function providing program that provides a scanner function, and a FAX function providing program that provides a FAX function. In addition, the HDD 235 stores passwords and IDs as user information to be used in a use authentication.

The control part 210 is a processor that controls an overall operation of the image forming apparatus 200. The control part 210 includes a scanner control part 211, a printer control part 212, a FAX (Facsimile) control part 213, a RAM (Random Access Memory) 214, a ROM (Read Only Memory) 215, a communication control part 216, a panel display control part 217, a disaster information acquiring part 218, a user authentication function part 219, an operation mode switching part 220, an HDD control part 221, and a system control part 222. In addition, these preceding parts are connected to a data bus 223.

The scanner control part 211 is a circuit for controlling a scanning operation of the scanner part 230. The printer control part 212 is a circuit for controlling a print operation of the printer part 231. The FAX control part 213 is a circuit for controlling an image data transmitting/receiving operation of the FAX part 232.

The RAM 214 is a work memory that is used for executing the program. The ROM 215 is a memory that stores control programs such as Boot Loader for checking the operation of each the part. The communication control part 216 is a circuit for controlling of the data transmission/receipt, via the I/F 233, to, for example, the information distributing server 100. The panel control part 217 is a circuit for controlling a display operation of the panel part 234.

The disaster information acquiring part 218 is a circuit for acquiring disaster information from the information distributing server 100.

The user authentication function part 219 is a circuit for collating inputted password and ID with registered password and ID. The disaster information acquiring part 218 determines, only when the collation results coincide, a user who has entered the user information has an operating authorization. The inputted password and ID are the user information inputted, via the panel part 234 or the like. In addition, the user authentication function part 219, based on a control list 400 that will be described later, activates or deactivates the user authentication function. The control list 400 is a list that illustrates the disaster information that the disaster information acquiring part 218 according to the alarm level. The details thereof will be described later.

The operation mode switching part 220 is a circuit that switches a current operation mode of the image forming apparatus 200 to a specific operation mode based on the control list 400, as will be detailed later, according to the alarm level of the disaster information acquired by the disaster information acquiring part 218. The details thereof will be described later. The current operation mode is an operation mode that is currently running. The current operation mode is, for example, either one of a first power saving mode, a second power saving mode, an emergency stop, and a normal mode. The first power saving mode is a low power mode for achieving an energy consumption reduction by, for example, turning off the touch panel (panel part 234), lamps, and the like. Under this low power mode, in a case where a printing data or FAX is received, the operation mode is automatically switched to the normal mode that allows for printing. In addition, the second power saving mode is a sleep mode for minimizing the energy consumption by, for example, lowering a temperature of a fixing part as well as turning off the touch panel (the panel part 234), lamps, and the like. Under this low power mode, in a case where a printing data or FAX is received, the operation mode is automatically switched to the normal mode that allows for printing. Further, the specific operation mode is either one of the first power saving mode, the second power saving mode, and the emergency stop, all of which are operation modes. It is to be noted that the current operation mode may be identical with a specific mode after a switching action of the operation mode switching mode 220. Even in such a case, in a sense of the specific operation mode from the current operation mode, such a case can be regarded as "switching a current operation mode into a specific operation mode."

The HDD control part 221 is a circuit that controls, for example, a data writing into/reading from the HDD 235. The system control part 222 is a circuit for controlling a collaborate operation between, for example, the disaster information acquiring part 218, the user authentication function part 219, and an operation mode switching part 220.

Next, with reference to FIG. 3, the control list 400 will be described that illustrates the disaster information distributed from the information distributing server 100 according to the alarm level. It is to be noted the disaster information indicated below is, for example, related to an earthquake.

First of all, the disaster information includes, for example, data items that are indicative of alarm level 1 to 6. Here, the alarm level 1 represents an earthquake's seismic intensity of about 1 to about 2. The alarm level 2 represents a seismic intensity of 3. The alarm level 3 represents a seismic intensity of 4. The alarm level 4 represents a seismic intensity of 5-lower. The alarm level 5 represents a seismic intensity of 5-upper to 6-lower. The alarm level 6 represents a seismic intensity of 6 or above.

In this connection, it is said that the seismic intensity of about 1 to about 2 causes only some people indoors to feel a shake. Also, it is said that the seismic intensity of 3 causes most people indoors to feel a shake. It is said that the seismic intensity of 4 causes most people walking to feel a shake. It is said that the seismic intensity of 5-lower may cause unfixed furniture to move. It is said that the seismic intensity of 5-upper to 6-lower makes most people to walk without holding a thing. It is said that the seismic intensity of 6-upper or above makes people difficult to keep standing and to move without crawling.

According to the control list 400 of the present disclosure, in a case where the alarm level is 1 to 2 i.e., the seismic intensity is 1 to 3, the control mode allows the user authentication function to maintain under the first energy saving mode (low power mode). In addition, in a case where the alarm level is 3 to 5 i.e., the seismic intensity is 4 to 6-lower, the control deactivates the user authentication under the second energy saving mode (sleep mode). Further, in a case where the alarm level is 6 i.e., the seismic intensity is 6-upper or above, the control mode is under the emergency stop.

It is to be noted that as described above, the first power saving mode is the low power mode for achieving an energy consumption reduction by, for example, turning off the touch panel (panel part 234), lamps, and the like. In addition, the second power saving mode is a sleep mode for minimizing the energy consumption by, for example, lowering a temperature of a fixing part as well as turning off the touch panel (the panel part 234), lamps, and the like.

Figure 4:
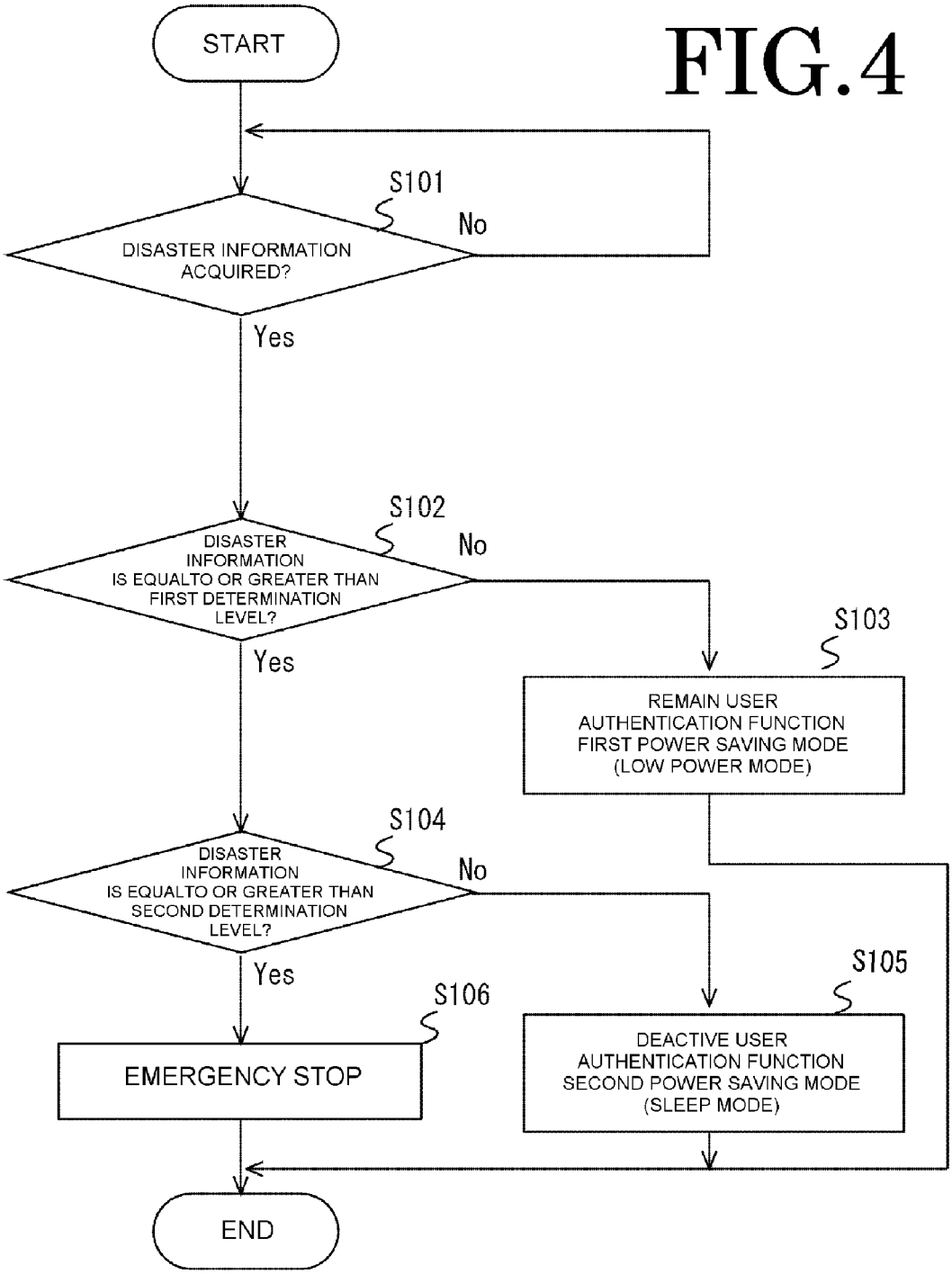
FIG. 4 illustrates control processes that are performed based on the disaster information in the image forming apparatus.

Next, with reference to FIG. 4, a description will be made regarding a control process of the image forming apparatus 200 which is implemented based on disaster information. It is to be noted that in the description that will be made hereinbelow, the system control part 222 sets the alarm level 3 selected from among the alarm levels 1 to 6 as a first determination level. In addition, the system control part 222 sets the alarm level 6 as a second determination level. The system control part 222 controls the user authentication function part 219 for the user authentication and the operation mode switching part 220 for switching to a specific operation mode.

First of all, the system control part 222 determines whether disaster information from the information distributing server 100 is acquired by the disaster information acquiring part 218 (step S101). If no disaster information from the information distributing server 100 is acquired by the disaster information acquiring part 218 (No: step S101), the control waits for acquiring disaster information. To the contrary, If disaster information from the information distributing server 100 is acquired by the disaster information acquiring part 218 (Yes: step S101), the system control part 222 determines whether or not the alarm level is the first determination level (the alarm level 3) or above (step S102).

If the system control part 222 determines that the alarm level is less than the first determination level (less than the alarm level 3) (step S102: No), the system control part 222 allows the user authentication function part 219 to maintain the user authentication function. In addition, the system control part 222 switches from the current mode to the first power saving mode (low power mode) (step S103). It is to be noted that the image forming apparatus 200 is under the first power saving mode (low power mode), the first power saving mode (low power mode) remains unchanged. In such a way, setting the image forming apparatus 100 under the first power saving mode (low power mode) makes it possible to achieve a quick transition to the second power saving mode (sleep mode) or the emergency stop when the alarm level becomes higher.

To the contrary, if the system control part 222 determines that the alarm level is the first determination level (the alarm level 3) or above (step S102: Yes), the system control part 222 determines whether or not the alarm level is the second determination level (the alarm level 6) or above (step S104).

If the system control part 222 determines that the alarm level is less than the second determination level (less than the alarm level 6) (step S104: No), the system control part 222 causes the user authentication function part 219 to deactivate the user authentication. In addition, the system control part 222 switches from the current mode to the second power saving mode (sleep mode) (step S103). It is to be noted that the image forming apparatus 200 is under the second power saving mode (sleep mode), the second power saving mode (sleep mode) remains unchanged. In such a way, deactivating the user authentication function makes it possible to take a quick action such as printing of rescue information without having to perform the user authentication even in a case of an emergency disaster. In addition, setting the image forming apparatus 100 under the second power saving mode (sleep mode) makes it possible to achieve a quick transition to the emergency stop when the alarm level becomes higher.

To the contrary, if the system control part 222 determines that the alarm level is the second determination level (the alarm level 6) or above (step S104: Yes), the system control part 222 causes the operation mode switching part 220 to apply an emergency stop (step S106). Thus, the emergency stopping of the image forming apparatus 200 makes it possible to prevent a possible heat generation at the heater of the fixing part even if the image forming apparatus 200 is overturned. Thus, it is possible to prevent a secondary disaster such as a fire.

In such a way, in the present exemplary embodiment, the system control part 222 controls the user authentication function and the switching action to a specified operation mode based on the alarm level that ranges from 1 to 6 of the disaster information acquired by the disaster information acquiring part 218. That is, the user authentication depends on the user authentication function part 219. In addition, Switching to a specific operation mode is made by the operation mode switching part 220 to either one of the first power saving mode, the second power saving mode, and the emergency stop.

It is to be noted that the aforementioned first power saving mode is, as described above, the low power mode for achieving an energy consumption reduction by, for example, turning off the touch panel (panel part 234), lamps, and the like. Under the low power mode, receiving a printing data or FAX causes a mode that is allowed to print to recover automatically.

In addition, the aforementioned second power saving mode is the sleep mode. The sleep mode, as described above, for minimizing the power consumption, lowers the temperature of the fixing part as well as turns off the touch panel (the panel part 234), lamps, and the like. In addition, temperature of fixing part is lowered and the power consumption makes minimum. Under the sleep mode, receiving the printing data or FAX causes a mode that is allowed to print to recover automatically. Thus, it changes to a mode allowable to print.

In detail, when the alarm levels 1 to 6 are less than the first determination level (less than the alarm level 3), the system control part 222 allows the user authentication function part 219 to maintain the user authentication function and causes the operation mode switching part 220 to switch from the current mode to the first power saving mode (low power mode). In addition, when the alarm levels 1 to 6 are the first determination level (equals to or greater than the alarm level 3) and concurrently are less than the second determination level (the alarm level 6), the system control part 222 causes the user authentication function part 219 to deactivate the user authentication function and causes the operation switching mode to switch from the current operation mode to the second power saving mode (sleep mode). Furthermore, when the alarm level that ranges from 1 to 6 is second determination level (equals or greater than the alarm level 6), the system control part 22 causes the operation mode switching part 220 to switch from the current operation mode to the emergency stop.

In such a way, depending on the alarm level, a control is made on the user authentication function and the switching action from the current mode to either one of the first power saving mode, the second power saving mode, and the emergency stop. Thus, based on the alarm level that ranges from 1 to 6 at a time emergency disaster such as earthquake, it is possible to deactivate the user authentication function. Concurrently, it is possible to switch to the power saving modes and emergency stop. Thereby, it is possible to reduce the power supplied to the heat source such as the fixing part that could lead to fire.

In particular, deactivating the user authentication function makes it possible, even at a time of emergency disaster, to print rescue assist information or the like in a quick manner without having to perform the user authentication. In addition, when the alarm level that ranges from 1 to 6 is the second determination level (equal or greater than the alarm level 6), the operation mode switching part 220 is caused to switch from the current operation mode to the emergency stop. Thereby, it makes it possible to prevent an outbreak of fire due to the heat source such as the heater of the fixing part, electric shock by a high voltage power source part, and splashing of toner or the like. Thus, it is possible to prevent a secondary disaster such as a fire or the like.

More specifically, at a time of emergency, the user authentication method in each of the aforementioned typical cases is free from complying with an ordinary operation user control. This makes it possible to release the operation right to all the users. Thus, it is possible for everyone to grasp the situation of the monitoring location.

However, at a time of emergency, in the user authentication method in typical cases, deactivating the user authentication function is not based on the signal level or content that is indicative of an emergency. For this reason, in a case where the preceding authentication function is applied to the aforementioned image forming apparatus, the resultant user authentication function is deactivated independent of the alarm level at a time of emergency disaster such as earthquake or the like.

In addition, there is a problem in that, at a time of emergency disaster such as earthquake or the like, switching to the power saving mode and emergency stop selectively is not established. The power saving mode or the emergency stop will reduce the power supplied to the heat source such as the fixing part that could lead to fire.

Whereas, according to depending on the alarm level, a control is made on the user authentication function and the switching action from the current mode to either one of the first power saving mode, the second power saving mode, and the emergency stop. Thus, based on the alarm level at a time emergency disaster such as earthquake, it is possible to deactivate the user authentication function. Concurrently, it is possible to switch to the power saving modes and emergency stop selectively. Under the power saving mode, it is possible to reduce the power supplied to the heat source such as the fixing part that could lead to fire.

It is to be noted that the present exemplary embodiment describes by taking an example wherein disaster information regarding an earthquake is acquired from the information. However, the disclosure is not limited to this example. The disaster information regarding may be related to a tidal, typhoon, heavy rain, storm, and volcano.

In addition, not only the information distributing server 100 but also a television broadcast or a radio broadcast may also be available as a source of the disaster information. In this case, the disaster information that is acquired from the television broadcast or the radio broadcast is, for example, a forecast, alarm, or special alarm. Using these as a determination level makes it possible to control the user authentication and the switching action to a specific mode. The user authentication is made by the user authentication function part 219. The specific mode to which the operation mode switching part 220 switches is either one of the first power saving mode, the second power saving mode, and the emergency stop.

In addition, if the alarm level that ranges from 1 to 6 is, for example, the second determination level (equal or greater than the alarm level 6), the system control 222 may delete secret information or the like in a compulsory manner that is stored on the HDD 222. This can ensure the prevention of a leakage of the secret information or the like even at a time of emergency disaster.

What is claimed is:

1. An image forming apparatus comprising:

a user authentication function circuit that performs a user authentication operation, wherein the user authentication function circuit can deactivate the user authentication operation such that printing from the image forming apparatus is allowed without requiring user authentication;

an operation mode switching circuit that performs a switching action that switches from a current operation mode to a specific operation mode;

a disaster information acquire circuit that acquires disaster information that is indicative of an alarm level; and a system control circuit that controls, depending on the alarm level, the user authentication operation by the user authentication function circuit and the switching action by the operation mode switching circuit; wherein the specified operation mode is one of a first power saving mode, a second power saving mode in which the power consumption thereof is less than the first power saving mode, and an emergency stop, wherein the operation mode switching circuit can switch from the current operation mode to one of said specified operation modes; and wherein when the alarm level is less than the first determination level, the system control circuit maintains the user authentication operation by the user authentication function circuit, and causes the operation mode switching circuit to switch to the first power saving mode;

when the alarm level is not less than the first determination level and is less than a second determination level the system control circuit deactivates the user authentication by the user authentication function circuit, and causes the operation mode switching circuit to switch to the second power saving mode; and when the alarm level is not less than the second determination level, the system control circuit causes the operation mode switching circuit to switch to the emergency stop.

2. A non-transitory computer readable medium that stores an image forming program, image forming program being capable of being implemented by a computer that controls an image forming apparatus, the image forming program comprising:

a first program code that causes the computer to operate a user authentication operation;

a second program code that causes the computer to switch from a current operation mode to a specific operation mode;

a third program code that causes the computer to acquire a disaster information that is indicative of an alarm level; and a fourth program code that causes the computer to control, depending on the alarm level, the user authentication operation by a user authentication function circuit and a switching action by an operation mode switching circuit; wherein the specific mode is one of a first power saving mode, a second power saving mode in which the power consumption thereof is less than the first power saving mode, and an emergency stop, wherein the second program code can cause to the computer switch from the current operation mode to one of said specified operation modes; and wherein when the alarm level is less than the first determination level, the fourth program code maintains the user authentication operation by the user authentication function circuit, and causes the second program code to cause the computer to switch to the first power saving mode;

when the alarm level is not less than the first determination level and is less than a second determination level, the fourth program code deactivates the user authentication operation by the user authentication function circuit, and causes the second program code to cause the computer to switch to the second power saving mode, wherein printing from the image forming apparatus is allowed without requiring user authentication when the user authentication operation is deactivated; and when the alarm level is not less than the second determination level, the fourth program code causes the second program code to cause the computer to switch to the emergency stop.

* * * * *